United States Patent [19]

Arendt

[11] 3,938,356

[45] Feb. 17, 1976

[54] WEB FINISHING MACHINES

[76] Inventor: Hans F. Arendt, Bleichinsel, 712 Bietigheim, Wurttemberg, Germany

[22] Filed: Sept. 26, 1973

[21] Appl. No.: 400,911

[30] Foreign Application Priority Data

Sept. 27, 1972 Germany ..... 2247320

[52] U.S. Cl. ..... 68/5 D; 68/19.1; 68/20; 68/205 R; 69/32

[51] Int. Cl.[2] D06B 3/02; D06B 21/00; C14C 15/00

[58] Field of Search ..... 68/5 A–5 D, 68/205 R, 19.1, 19.2, 20, DIG. 5; 34/110, DIG. 16, 151–155; 118/641, 643, 325, 27; 117/10–11, 66; 28/1.3; 26/20; 69/29, 30, 32

[56] References Cited

UNITED STATES PATENTS

| | | | |
|---|---|---|---|
| 3,060,711 | 10/1962 | Walter | 68/5 D |
| 3,091,547 | 5/1963 | Jones | 117/11 |
| 3,524,792 | 8/1970 | Dawes | 117/11 |
| 3,597,851 | 8/1971 | Arendt | 68/5 D |
| 3,770,481 | 11/1973 | Canat | 117/11 |
| 3,776,004 | 12/1973 | Fleissner | 68/DIG. 5 |

FOREIGN PATENTS OR APPLICATIONS

| | | |
|---|---|---|
| 1,954,571 | 5/1971 | Germany |

*Primary Examiner*—Edward L. Roberts
*Assistant Examiner*—Philip R. Coe
*Attorney, Agent, or Firm*—Littlepage, Quaintance, Murphy & Dobyns

[57] ABSTRACT

A machine for the continuous finishing of webs of textile or artificial leather material or the like in accordance with a variety of finishing processes, the machine comprising a reversible continuous flow drum having web feed and withdrawal devices, the feed device being associated with direct radiation means, one or more moistening devices and one or more devices for applying additives, and the drum being mounted in a casing in which are provided a ventilation device, at least one steam spraying device and a radiator, the component of the machine being independently controllable and the drive of the drum being adjustable for achieving any desired angle of rotation of the drum.

11 Claims, 3 Drawing Figures

WEB FINISHING MACHINES

BACKGROUND OF THE INVENTION

1. Field of the Invention

The present invention relates to a universal machine for the continuous finishing of, for example, textile or artificial leather webs, the machine having a reversible continuous flow drum with a feed and withdrawal device for the web material.

2. Description of the Prior Art

Machines of this type are known which serve for the production of a grain in artificial leather. An example is to be found in German Auslegeschrift 1,954,571.

Continuous flow drying drums are also known which are equipped with a radiator and a ventilation device. However, these drums have no feed and withdrawal device for web material. An apparatus of this type is to be found in U.S. Pat. No. 2,469,882.

In addition, drying drums having a batch type operation have already been provided with a steam-spray device in order to be able to use them for shrinking and thermo-setting textiles. U.S. Pat. No. 3,597,851 discloses an apparatus of this kind.

In addition to wet finishing, the thermo-mechanical finishing of textiles has gained increasing significance. Appropriate machines have been used for achieving the desired, often conflicting effects. Owing to the variety of the effects to be achieved, much depends on the method of operation of the corresponding devices and mastering the technology can be difficulties. One is largely dependent on empirical results. Additional difficulties occur when transferring this technology to machine operating continuously.

SUMMARY OF THE INVENTION

It is the object of the invention to provide a continuous finishing machine which makes it possible to achieve the various known effects which previously could only be partly attained in machines operating discontinuously, and which also makes it possible to achieve new effects.

According to the present invention, there is provided a machine for the continuous finishing of webs, comprising a reversible continuous flow drum having web feed and withdrawal devices, the feed device being associated with direct radiation means, one or more moistening devices and one or more devices for applying additives, and the drum being mounted in a casing in which are provided a ventilation device, at least one steam spraying device and a radiator, the components of the machine being independently controllable and the drive of the drum being adjustable for achieving any desired angle of rotation of the drum.

With a machine of this type it is possible for example to thermo-set artificial leather whilst achieving various types of grains. The artificial leather can also be rendered porous. Terry-type stitches and velour loops can be made to stand up, and crush effects may also be produced in the case of velvet. The machine may be used as a drying drum after dyeing and during the wet treatment of textiles, the web leaving the drum in a completely smooth condition without any formation of creases.

In a preferred embodiment of the machine, infra-red radiators are used as radiation means. It has been shown that a radiator of this type has particular advantages and in particular contributes to achieving the desired effects in a better and more accurate manner.

It is appropriate to construct the radiator in a known manner for providing indirect infra-red radiation.

The moistening device preferably comprises spray nozzles arranged so that in use they are directed towards the upper and/or lower side of the moving web. It may also be constructed so as to be able to apply additives.

An axial suction channel may be arranged below the drum in the drum casing for ventilating the drum. The ventilation of the drum may appropriately be controlled by controlling the speed and amount of air supplied and in addition the air circulation may be guided and controlled by flaps in a circuit and/or passage.

An air intake is most appropriately arranged above and adjacent the upper part of the drum and an air exhaust is preferably arranged below the drum, both the inlet and the outlet being adjustable.

The drum drive preferably consists of two contrarotating motors which may be controlled by at least one magnetic clutch and a separate drum controlled circuit may be provided for each motor clutch.

It is also advantageous to construct the feed and withdrawal devices such that they may be individually switched and controlled.

DETAILED DESCRIPTION OF THE PREFERRED EMBODIMENT

Figure 1:
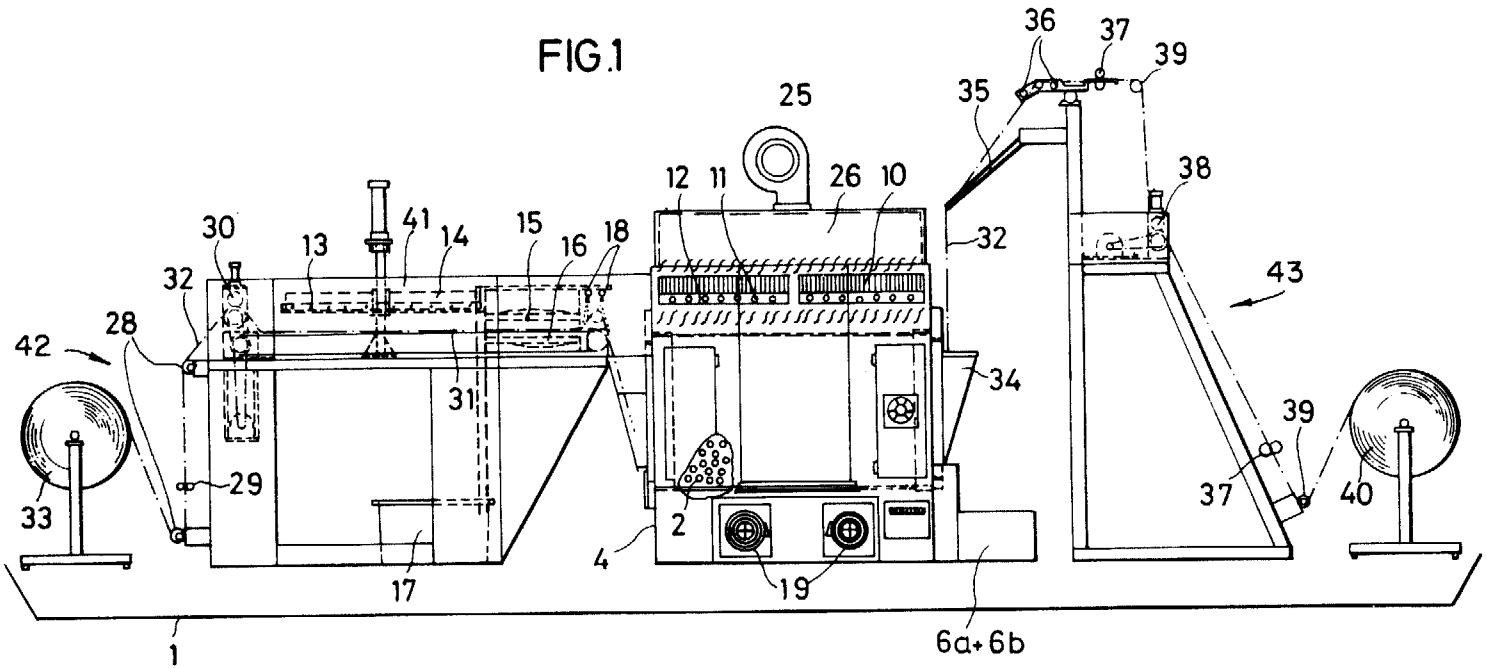
FIG. 1 diagrammatically illustrates a machine according to the invention in longitudinal section.
Figure 2:
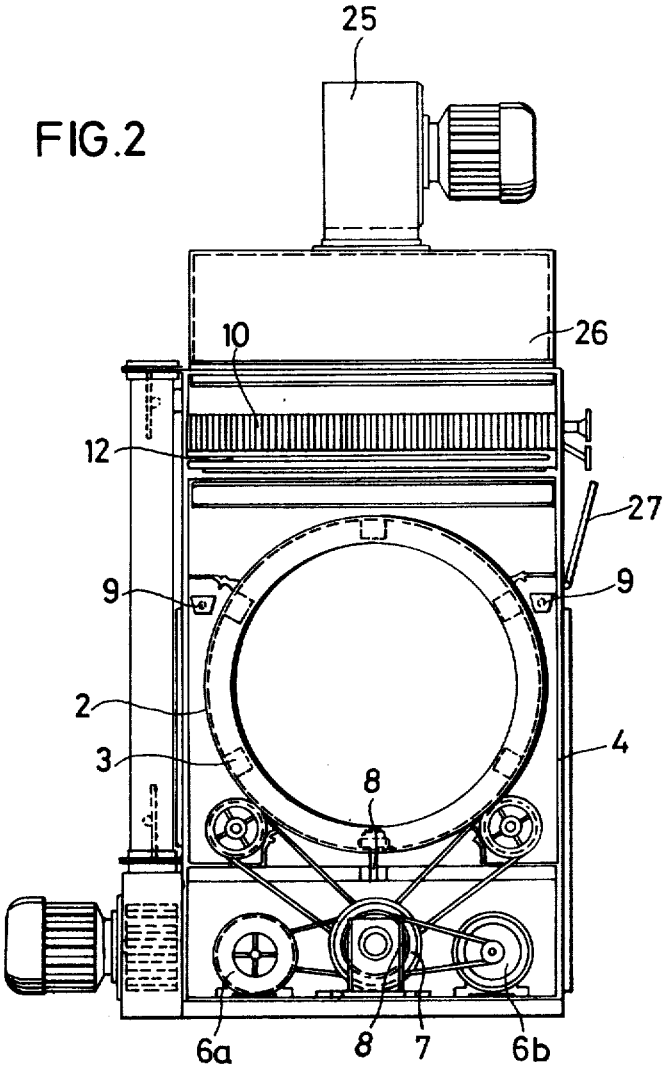
FIG. 2 shows the machine drum as seen from the delivery and with the rear walls removed.
Figure 3:
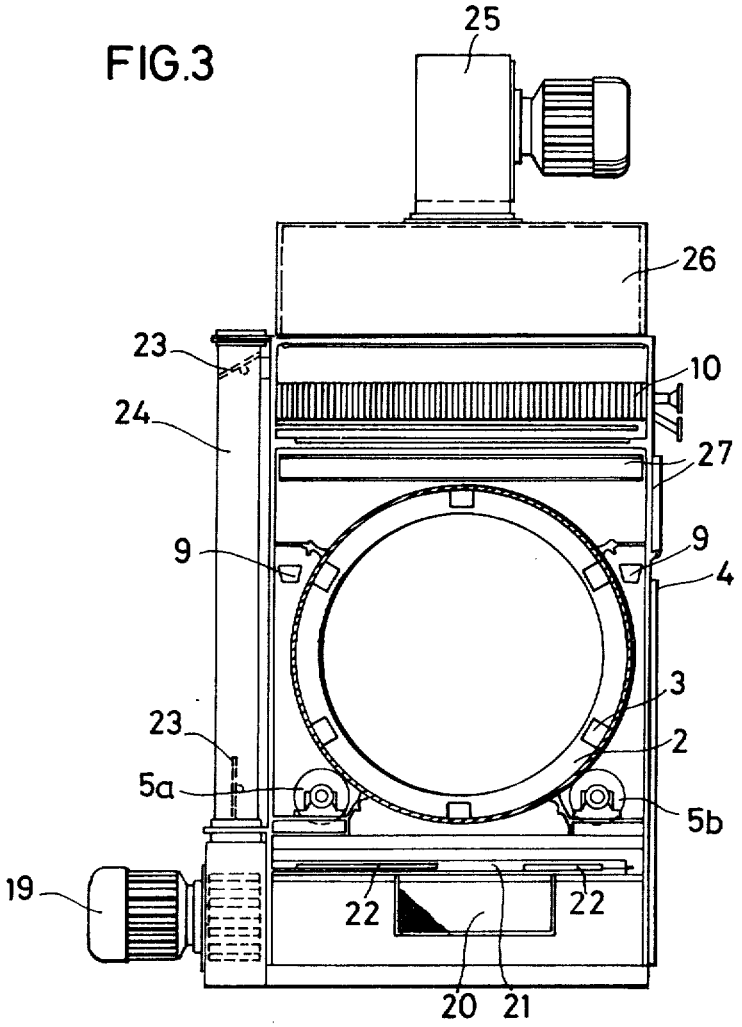
FIG. 3 is a cross-section through the drum.

The machine 1 comprises a perforated drum 2 provided with entrainment ribs 3 and arranged in a casing 4. The drum 2 is mounted on rollers 5*a* and 5*b*, each of which has a separate drive 6*a*, 6*b* and a magnetic clutch 7. Furthermore, an electronically controlled braking device 8 is provided for the exact braking of the drum 2.

Located above or adjacent the drum are steam-spray nozzles 9, a heater 10 and a heater consisting of radiators 11 for indirect infra-red radiation 12. Further infra-red radiators 13 are combined to form a direct radiator 14 arranged in front of the drum 2. A moistening device is provided in front of the drum 2 and comprises steam-spray nozzles 15 and 16, at least one of which may be connected to containers 17 from which additives such as impregnating or finishing agents and the like may be drawn for spraying. However, additives may also be sprayed with a special spray device 18.

The drum 2 is ventilated by means of fans 19 which suck air from the drum casing 4 through an axial channel 20 located thereunder. An opening 21 is provided between the casing 4 and the channel 20, the width of the opening 21 being adjustable by movement of slide plates 22 and the opening 21 being displacable at right angles to the axis of the drum. The air stream which is removed by suction is controlled by means of flaps 23 in an air outlet channel 24. The opening 21 may have different widths over its length, for example by dividing the slide plate 22 into individual sections of the drum casing. The outlet air sucked out by the fans 19 may be guided in a circuit and returned from above into the drum casing 4.

A pressure fan 25 located on the upper part of the drum casing 4 supplies fresh air through a pressure shaft 26. Further fresh air may be supplied to the drum 2 directly by actuating the flaps 27. The machine also comprises a feeder device consisting of guide rollers 28, material web guides 29, withdrawal rollers 30, and a conveyor belt 31 which feeds a material web 32 from a roll of material 33. Arranged at the drum outlet on the casing 4 is an outlet funnel 34 from where the material web 32 is wound on a roller 40 via a spreading bracket 35, an edge unrolling device 36, a material web guide 37, withdrawal rollers 38 and guide rollers 39.

The material web 32 withdrawn from the roll of material 33 is first supplied to the radiation means 14, whose infra-red radiators 13 are arranged in several groups and can be switched on and off separately and infinitely adjusted. In this case, the material is spread out on the conveyor 31 which must have sufficient length in order to be able to serve, if necessary, as a drying section for the material. For this reason, the radiation means 14 and conveyor 31 are appropriately included in a housing 41 attached to the drum casing 4, if necessary including the section where the material web falls behind the spray nozzles 15 and 16. In this case, the nozzles 15 and 16 are directed towards the underside or upper side of the material web. The material must be moved in the drum 2 with sufficient speed such that it lies against the drum wall or entrainment ribs 3 for the shortest possible time. On account of the temperature prevailing in the drum, of the order of magnitude of approximately 200°C, it is important to keep the contacts time of the material web with these surfaces as short as possible. To avoid twisting of the material, a reversible drive is necessary. In this case, the braking and starting up times of the drum are to be kept as short as possible in order to avoid substantially longer contact times of the material and drum wall during this period.

During the rotation of the drum, the web introduced loosely into the drum is subjected to a certain twisting action. The degree of this twisting depends on the angle of rotation of the drum, on the number of revolutions and if an uneven number of entrainment ribs 3 are provided, also on the respective initial position of the drum, i.e. on the type of trajectory of the material web produced. This may also be influenced by the air currents and turbulence prevailing in the drum. It has been shown that the action of the air on the two symmetrical halves of the drum divided by an imaginary vertical axial plane must be the same. In order for the degree of twisting to be independent of the initial position of the drum, it is advisable to provide a minimum number of six entrainment ribs. It has also been shown that the desired action of the air is achieved most easily if the air movement is produced by fans 19 and 25 which introduces the air from above the drum and remove it by suction via the channel 20 located in the plane of separation below the drum. Nevertheless, it may be necessary to select different angles of rotation for the respective directions of rotation of the drum 2. The air flaps 23 and 27 serve for the selective introduction of re-circulated air from the fans 19 and fresh air respectively. Further fresh air may be sucked in through the outlet funnel 34 to cool the material web 32.

The material web is also subject to the effects of the centrifugal force occurring during rotation of the drum and of specific gravity. In order to avoid twisting and knotting of the material, a delicate equilibrium of all these factors must be maintained.

Apart from twisting, the occurrence of an irregular material distribution over the length of the drum must be avoided. This may be done by altering the intensity of the air currents in different sections of the drum, in particular by setting a varying width of the opening 21 of the channel 20. However, since twisting of the material influences its distribution in the drum and vice versa, the achievement of a satisfactory passage of material through the drum is only possible by mutual co-ordination of all the control factors.

The material web 32 leaves the drum in a more or less folded condition and is opened and spread out between the brackets 35 in co-operation with the edge unrolling device 36 and the material web guides 37 as well as the withdrawal rollers 38, whereupon it is supplied to and wound on the roller 40. It should be noted that the length of the material is usually changed by the treatment due to, the example, shrinkage. Therefore, in order to achieve constant filling of the drum, the material must be withdrawn at a speed differing from that of the feed. Also, since the treatment in the machine differs depending on the type of material and the type of effect to be achieved, the individual devices such as the radiation means 14, spray nozzles 15 and 16, the radiator 10, radiation means 12 and spray nozzles 18, or if necessary their sections, must be able to be switched on and off individually and independently of each other. Also, for the above mentioned reasons, the drum drive consists of two contra-rotating motors **6*a* and 6*b* which may be switched on and off independently, which, for further reduction of the change over times, may be controlled by at least one magnetic clutch 7.**

Some of the effects which may be achieved by treatment in the machine are described by several examples hereafter.

EXAMPLE 1.

A web of synthetic material consisting of a cotton fabric with a single component polyurethane coating on one side was subjected four days after manufacture to infrared radiation in the machine with a speed of travel of 4m/min and then sprayed with steam on the surface. The subsequent treatment in the drum having a diameter of approximately 1.50m lasted eleven minutes at an air temperature of approximately 120°C without spraying additional steam. The material was fixed by the treatment, and the surface exhibited a coarse leather-like grain.

EXAMPLE 2

A web of synthetic material with a two-component polyurethane coating on a cotton fabric base was treated 24 hours after production according to Example 1.

The material exhibited a fine grain and was also permeable to air owing to fine pores occurring during the treatment.

EXAMPLE 3

An acrylic plush was subjected to the treatment according to Example 1. After treatment, the material exhibited a crush effect.

EXAMPLE 4

A material corresponding to the plush of Example 4 but very wrinkled was treated according to Example 1, but at an air temperature of 100°C. After the treatment, the material was completely smooth and exhibited no crush effect.

EXAMPLE 5

Dry terry material was subjected to steam treatment on both sides in the machine. Then, the spray device for additives was used to spray a cloud of water vapour on the material. The treatment in the machine took place at 180°C and at a travelling speed of 8m/min. As a result of the treatment, the material was finished so that it was shrink resistant and exhibited erect terry material loops.

EXAMPLE 6

Wet terry material was subjected to infra-red radiation and then treated in the drum at 200°C and at a travelling speed of 8m/min. The effect achieved corresponded to that according to Example 5.

EXAMPLE 7

Deep pile material (imitation fur) with an acrylic two-component pile was subjected to slight infra-red radiation, lightly moistened from above and then treated for 20 minutes in the drum at 120°C and reduced air speed with a travelling speed of 2.5m/min. An excellent fur effect was obtained.

EXAMPLE 8

Example 7 was repeated but with a material having a polyester pile. The latter accordingly showed a slight crimped effect.

In summary, the machine 1 for the continuous finishing of webs 32 comprises a reversible continuous flow drum 2 having web feed devices 42 and web withdrawal devices 43. The feed device 42 includes a direct radiation means 14, one or more moistening devices 15, 16 and one or more devices 16, 18, for applying additives. The drum 2 is mounted in a casing 4 in which are provided a ventilation device 19, at least one steam spraying device 9 and a radiator 10. The components of the machine are independently controllable and the drive of the drum being adjustable in any manner well known in the art for achieving a desired angle of rotation of the drum. The direct radiation means 14 within the web feed device 42 perferably comprises an infrared radiator 13 adapted to provide infrared radiation on the moving web 32. The moistening devices 15, 16 preferably comprise spray nozzles arranged so as to be directed towards the upper and lower sides of the moving web 32.

What is claimed is:

1. A machine for continuously finishing a web of material comprising the combination of a casing, a drum mounted for rotation within the casing, web feeding means for introducing the web into the drum, the web traveling continuously through the interior of the drum, web withdrawal means for withdrawing the web from the drum and casing, ventilating means fixed to the casing for removing air from and introducing fresh air to the drum and casing, steam spraying means fixed to the casing for spraying steam into the drum, a heater mounted within the casing and above the drum for directing heat and infrared radiation to the drum, the web feeding means further comprising a housing attached to the casing through which the web travels, direct radiation means within the housing for directing infrared radiation onto the web, and moistening means within the housing and following the direct radiation means for moistening the web prior to its introduction into the drum.

2. A machine according to claim 1, wherein said ventilating means further comprises an axial ventilation channel arranged in the casing below the drum.

3. A machine according to claim 1, wherein said ventilating means further comprises an air inlet located above and adjacent to the upper part of the drum and an air outlet located below the drum, the air inlet and air outlet being adjustable.

4. A machine according to claim 1, further comprising a drum drive consisting of two contra-rotating motors which are controlled by at least one magnetic clutch.

5. A machine according to claim 1, wherein the drum is provided with an even number of entrainment ribs.

6. The combination of claim 1 wherein the web feeding means further comprises a conveyor means for conveying the web through the housing toward the drum.

7. The combination of claim 1 wherein the moistening means comprises spray nozzles arranged within the housing to spray the upper and lower sides of the moving web.

8. The combination of claim 7 wherein the spray nozzles are connected to a container within the housing.

9. The combination of claim 1 further comprising a spray device positioned within the housing immediately adjacent to the drum and casing and attached to a container located within the housing.

10. In a machine for continuously finishing a web of material comprising the combination of a casing, a drum mounted for rotation within the casing, a web feeding means for introducing the web into the drum, the web traveling continuously through the interior of the drum, ventilating means fixed to the casing for removing air from and introducing fresh air to the drum and casing, steam spraying means fixed to the casing for spraying steam into the drum, a heater mounted within the casing and above the drum for directing heat and infrared radiation into the drum, and web withdrawal means for withdrawing the web from the drum and casing, the improvement comprising:

the web feeding means comprising a housing through which the web travels, one end of the housing being attached to the drum casing, withdrawal rollers located at an end of the housing opposite that attached to the drum casing for withdrawing at the web from a roll of material, a conveyor belt extending longitudinally through the housing for conveying the web from the withdrawal rollers to the drum casing, direct radiation means mounted within the housing, following the withdrawal rollers, and above the conveyor belt for directing infrared radiation onto the web, and moistening means positioned within the housing and following the direct radiation means for moistening the web prior to its introduction to the drum, the moistening means arranged so as to direct moisture toward the upper and lower side of the moving web.

11. The apparatus of claim 10 further comprising a spray device positioned within the housing immediately adjacent to the drum casing and connected to a container positioned within the housing for spraying web impregnating and finishing agents on the web.

* * * * *